US006640059B2

(12) United States Patent
Fromm et al.

(10) Patent No.: US 6,640,059 B2
(45) Date of Patent: Oct. 28, 2003

(54) APPARATUS FOR FACILITATING JAM CLEARANCE IN A PRINTER

(75) Inventors: Paul M. Fromm, Rochester, NY (US); Richard C. Benton, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/022,899

(22) Filed: Dec. 20, 2001

(65) Prior Publication Data

US 2003/0118357 A1 Jun. 26, 2003

(51) Int. Cl.[7] ..... G03G 15/00

(52) U.S. Cl. ..... 399/21; 399/22; 399/124; 399/322

(58) Field of Search ..... 399/21, 22, 124, 399/322, 323, 405

(56) References Cited

U.S. PATENT DOCUMENTS

| | | | | |
|---|---|---|---|---|
| 4,497,569 A | | 2/1985 | Booth, Sr. | |
| 5,245,395 A | | 9/1993 | Pawlik et al. | |
| 5,822,668 A | | 10/1998 | Fromm et al. | 399/323 |
| 5,839,032 A | | 11/1998 | Yasui et al. | 399/124 |
| 6,236,824 B1 | * | 5/2001 | Pardubitzki | 399/124 |
| 6,393,246 B2 | * | 5/2002 | Tsujihara | 399/322 |

FOREIGN PATENT DOCUMENTS

| | | |
|---|---|---|
| EP | 0 278 237 A1 | 8/1988 |
| EP | 0 870 707 A1 | 10/1998 |
| JP | 62-102266 | 5/1987 |
| JP | 63-87464 | 4/1988 |

OTHER PUBLICATIONS

European Search Report.

* cited by examiner

*Primary Examiner*—William J. Royer
(74) *Attorney, Agent, or Firm*—R. Hutter

(57) ABSTRACT

In an apparatus, such as a fuser for xerographic printing, wherein sheets pass through a nip formed by two moving rollers, a substantially enclosed, effectively funnel-shaped path is defined to direct sheets from the nip to a subsequent processing station. When a jam condition occurs in the path, a movable surface defining the path moves to increase a size of the path. The increase in size prevents impaction of subsequent sheets entering the path, and also facilitates manual jam clearance.

21 Claims, 3 Drawing Sheets

APPARATUS FOR FACILITATING JAM CLEARANCE IN A PRINTER

FIELD OF THE INVENTION

The present invention relates to printing apparatus, in particular to clearance of jammed sheets as could be found in the post-fuser path of a xerographic printer or copier.

BACKGROUND OF THE INVENTION

In electrophotographic printers commonly in use today, a charge-retentive member is charged to a uniform potential and thereafter exposed to a light image of an original document to be reproduced. The exposure discharges the charge-retentive surface in exposed or background areas and creates an electrostatic latent image on the member which corresponds to the image areas contained within the original document. Subsequently, the electrostatic latent image on the charge-retentive surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas on the charge-retentive member to form a powder image on a photoconductive area. This image is subsequently transferred to a support surface, such as copy paper, to which it is permanently affixed by heating or by the application of pressure. Following transfer of the toner image to a support surface, the charge-retentive member is cleaned of any residual toner that may remain thereon in preparation for the next imaging cycle.

One approach to fixing, or "fusing," the toner image is applying heat and pressure by passing the copy paper or print sheet containing the unfused toner images between a pair of opposed roller members at least one of which is internally heated. During this procedure, the temperature of the toner material is elevated to a temperature at which the toner material coalesces and becomes tacky. This heating causes the toner to flow to some extent into the fibers or pores of the sheet. Thereafter, as the toner material cools, solidification of the toner material causes the toner material to become bonded to the sheet.

After the fusing step, it is common that the resulting output sheet be fed to a subsequent processing station, such as an inverter, collator, stapler, booklet maker and the like. In order to direct a sheet emerging from the fuser rolls to the next processing station, it is common that the volume of space immediately downstream of the fuser in the process direction, which can be called the "post-fuser path" be effectively shaped in a funnel configuration, so that a sheet passing through the post-fuser path is directed toward a fairly narrow opening, such as toward a stapler.

FIG. 1 is an elevational view of some basic elements of an electrostatographic printer, illustrating a practical problem addressed by the present invention. Blank sheets are drawn one at a time from a supply stack 100 and conveyed, by known means, through a paper path 102 along a process direction P. At a charge-retentive surface such as on photoreceptor 104, marking material forming an image is electrostatically transferred to each sheet by one or more corotrons 106 or equivalent devices. Following transfer, the sheet is sent through fuser rolls 108 and 110. After fusing, the sheet can be sent on for further processing, such as stapling or binding.

Following the fuser along process direction P, it is typical that the sheets pass through the post-fuser path which is of a general funnel shape, such as formed by surfaces of baffles 10 and 12, whereby the vertical width of the path decreases to a relatively narrow slot 14, through which the sheet can be directed to a subsequent processing station.

As can be seen in FIG. 1, a problem can occur if the subsequent processing station following slot 14 is unable to accept input of a sheet, such as if the station is malfunctioning. If a sheet S cannot be accepted through slot 14 and is nonetheless pushed forward by the motion of fuser rolls 108, 110, the sheet S will jam and be compacted between surfaces formed by baffles 10 and 12. The funnel-like surfaces of the baffles 10, 12 tend to exacerbate a jamming problem, because the shape causes a very compact accordion-folding of the moving sheet. The post-fuser path will fill up quickly with one or more sheets, and the compaction of sheets is liable to damage the hardware around baffles 10 and 12.

The present invention is directed toward avoiding and obviating damage that can be caused in a post-fuser path in a printing apparatus, or indeed any post-roller path in any apparatus which feeds sheet material.

DESCRIPTION OF THE PRIOR ART

U.S. Pat. No. 5,245,395 discloses a fusing apparatus wherein a baffle associated with stripper fingers on an exit side of the apparatus imparts an arcuate profile on sheets emerging from the apparatus; this tends to prevent longitudinal waves from forming in the sheet.

U.S. Pat. No. 5,822,668 discloses a fusing apparatus which pivots open on its exit side for jam clearance. Various stripper fingers and plates are mounted on the pivoting exit side of the apparatus.

SUMMARY OF THE INVENTION

According to one aspect of the present invention, there is provided an apparatus useful in moving sheets, comprising a first roller and a second roller, forming a nip therebetween; means defining a substantially enclosed post-roller path downstream of the nip along a process direction toward an output opening; and opening means for increasing a size of the post-roller path.

BRIEF DESCRIPTION OF THE DRAWINGS

In the various Figures, like numerals indicate functionally analogous elements.

DETAILED DESCRIPTION OF THE INVENTION

Figure 2:
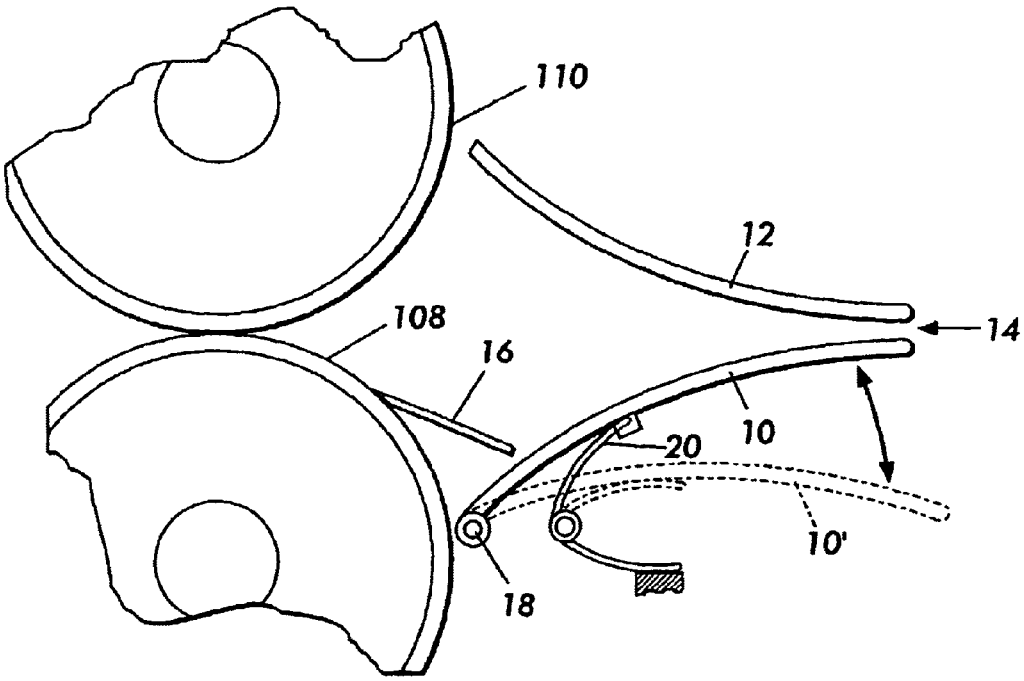
FIG. 2 is an elevational view of a post-fuser path in an electrostatographic printer, showing one embodiment of the present invention.

FIG. 2 is an elevational view of a post-fuser path in an electrostatographic printer, showing one embodiment of the present invention. At the exit side of the fusing apparatus formed largely by fuser rolls 108 and 110, surfaces defining the post-fuser path to the output opening, or slot, 14 are defined by what can be called plates or "baffles" 10 and 12. (Although baffles 10 and 12 are shown as smooth plates in the illustrated embodiments, either of the surfaces converging toward slot 14 can be effectively formed by fingers, ridges, and the like, or to some extent by surfaces of neighboring hardware.) As can be seen, in a basic state, the baffles 10 and 12 form a funnel in the vertical direction, wherein the vertical cross-section of the post-fuser path decreases along the process direction. More broadly, the surfaces of baffles 10 and 12 in effect substantially enclose the post-fuser path for purposes of directing sheets from the nip between fuser rolls 108 and 110 to the slot 14.

In a typical fuser apparatus, there is further provided one or more stripper fingers such as 16, which have the purpose of stripping sheets from the image-side (in this case, the lower side) of sheets emerging from the nip between fuser rolls 108 and 110. Such stripper fingers 16 and their associated mounts (not shown) are likely to be damaged by the impaction of sheets within the post-fuser path.

Figure 1:
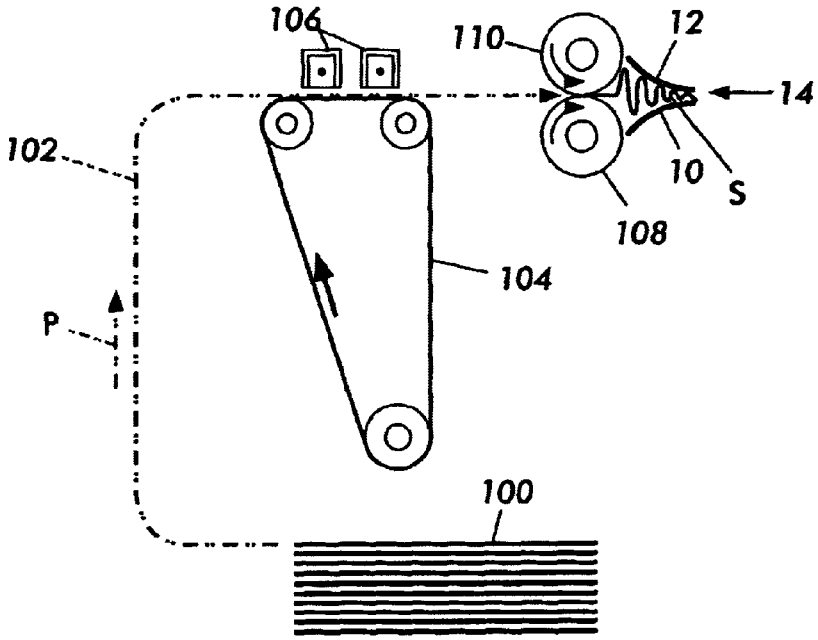
FIG. 1 (Prior Art)
FIG. 1 is an elevational view of elements of an electrostatographic printer in the prior art, illustrating a problem addressed by the present invention.

According to the FIG. 2 embodiment, the lower baffle 10 is pivotably mounted, such as on hinge 18, within the body of the printing machine, and thus provides a movable surface defining the post-fuser path. Further, the baffle 10 is held in a basic position by a spring force provided by a spring 20, which can be a spring of any type, and could include, for example, a counterweight system to provide the spring force. As can be seen by the "down" or "open" position of the baffle indicated as 10', any downward force greater than the spring force of spring 20 will cause the baffle 10 to be pushed downward, and, as shown increase a size of or in other words "open" the post-fuser path. The downward force would of course be provided by the presence of any sheets stuck in the post-fuser path, or in other words a "jam condition," such as shown in FIG. 1.

By thus "opening" the post-fuser path, first, more volume is available to avoid further compaction of sheets fed into the post-fuser path; and, second, the crumpled jammed sheets can be relatively easily removed by hand from the post-fuser path. In this embodiment, after the crumpled sheets are removed from the post-fuser path, spring 20 will return baffle 10 to its basic position.

In the FIG. 2 embodiment, a spring force associated with spring 20 is chosen based on the expected force of sheets being crumpled by jamming within the post-fuser path, which in turn may be affected by, for instance, the speed of sheets being fed through fuser rolls 108, 110.

Figure 3:
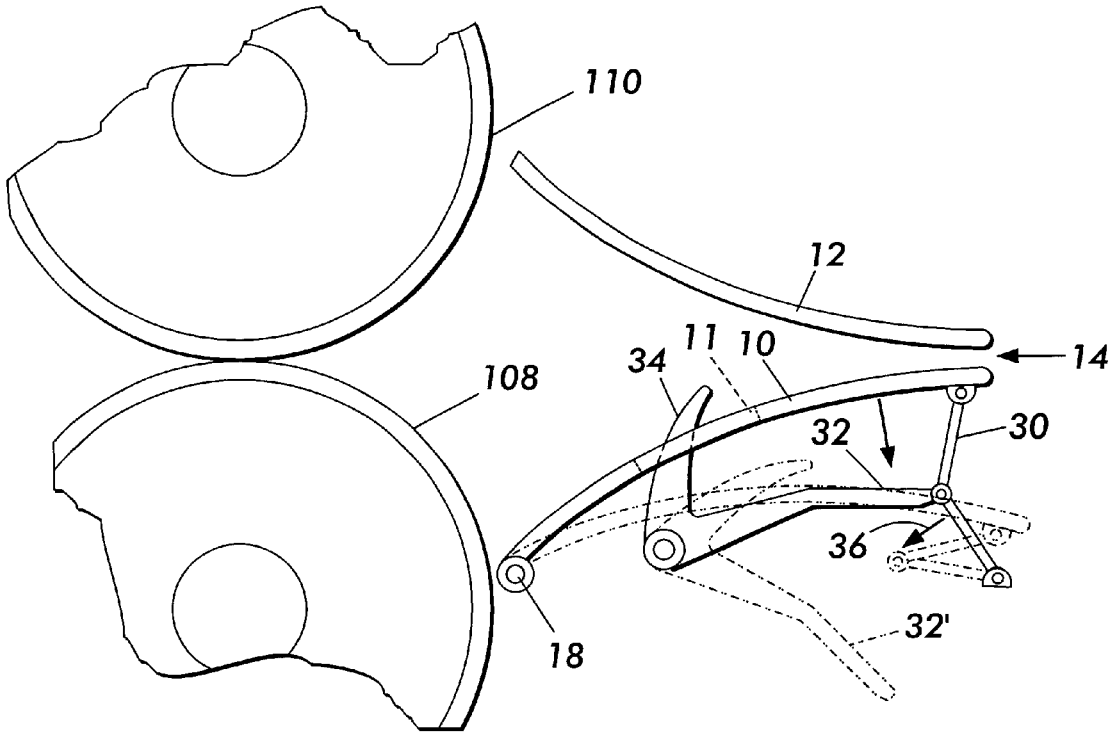
FIG. 3 is an elevational view of a post-fuser path in an electrostatographic printer, showing another embodiment of the present invention.

FIG. 3 shows another embodiment of the present invention. Instead of being springably mounted as in the previous embodiment, in FIG. 3 the lower baffle 10 is supported in its basic upward position by a flexible linkage generally indicated as 30. The linkage 30 is in turn held in place by a trip member indicated as 32. A portion 34 of trip member 32 extends through an opening 11 in baffle 10 and into the post-fuser path, and is thus positioned to contact a jammed sheet in the post-fuser path. When the post-fuser path fills up with a crumpled sheet during a jam condition, eventually the sheet will push down portion 34, and, as shown in FIG. 3, trip member 32 will assume the position shown in phantom as 32'. When this occurs, linkage 30 is no longer supported by trip member 32 and will then flex in the direction shown by arrow 36. When linkage 30 thus flexes, baffle 10 will move downward, in a similar manner as in the FIG. 2 embodiment, and the volume of the post-fuser path will open, as described above, to avoid compaction and provide easy removal of crumpled sheets. After crumpled sheets are removed, baffle 10 can be returned to its basic, upward position, and the trip member 32 can be reset to once again support flexible linkage 30.

Although FIG. 3 shows one arrangement of hardware to enable a "trip" for opening the volume in the post-fuser path, other mechanical arrangements having substantially the same effect would be apparent to one of skill in the art. Such arrangements may include springs or equivalent elements to enhance performance, either in determining under what conditions baffle 10 should move downwards, and/or to facilitate a reset of baffle 10 to its basic position.

Figure 4:
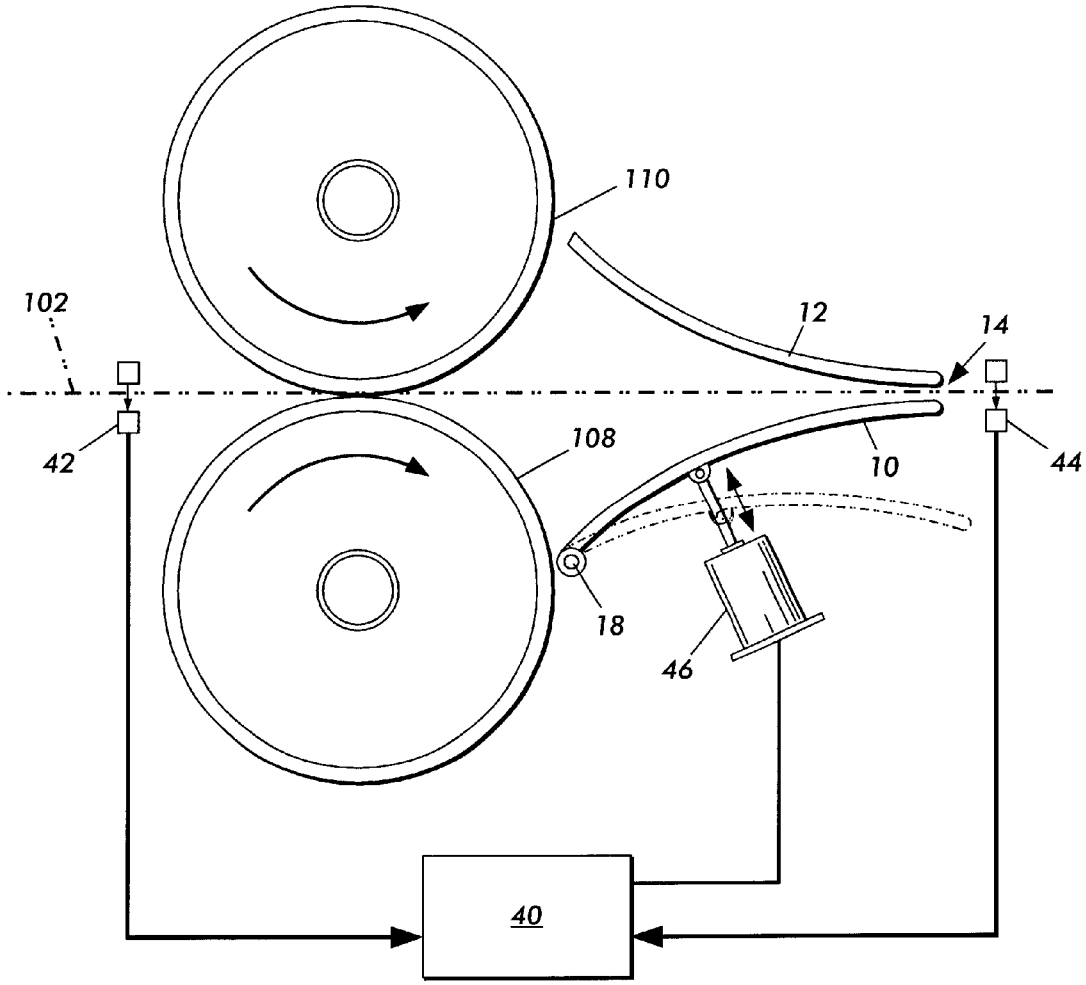
FIG. 4 is an elevational view of a post-fuser path in an electrostatographic printer, showing another embodiment of the present invention.

FIG. 4 shows another embodiment of the present invention. In this embodiment, the position of lower baffle 10 is directly controlled by an electronic control system, here indicated as 40. Of course control system 40 can be embodied as a routine within a larger control system governing the entire printing apparatus. In this embodiment, jamming conditions within the post-fuser path can be inferred by monitoring the behavior of sheets passing into the fuser nip between fuser rolls 108 and 110 and exiting through slot 14. Briefly, a monitor 42 (which may be of any variety used in determining sheet position, such as a mechanical sensor or an optical sensor) monitors the feeding of sheets into the fuser, and if the apparatus is working properly, a sheet detected at monitor 42 should be detected at a monitor 44, disposed along paper path 102 just after slot 14, within a predetermined time window thereafter. If a sheet detected by monitor 42 is not matched by a subsequent detection of the sheet by monitor 44, the condition is consistent with a jam in the post-fuser path. Control system 40, detecting this condition, then causes baffle 10 to move to a downward position which opens the post-fuser path. The downward movement of baffle 10 can be performed by an electromechanical actuator 46 of any type, such as an electromagnetic plunger or servomotor.

Although the illustrated embodiments of the present invention are directed toward avoiding and obviating damage that can be caused in a post-fuser path in a printing apparatus, the invention can be applied to any post-roller path in any apparatus which feeds sheet material.

What is claimed is:

1. An apparatus useful in moving sheets, comprising:

a first roller and a second roller, forming a nip therebetween;

means defining a substantially enclosed post-roller path downstream of the nip along a process direction toward an output opening;

opening means for increasing a size of the post-roller path;

detecting means for detecting a jam condition within the post-roller path; and wherein the opening means increases a size of the post-roller path in response to detecting a jam condition.

2. The apparatus of claim 1, wherein a dimension of the post-roller path decreases from the nip to the output opening.

3. The apparatus of claim 1, the means defining the post-roller path including at least one movable surface.

4. The apparatus of claim 3, further comprising at least one spring for holding the movable surface in a basic position with a predetermined spring force.

5. The apparatus of claim 3, the opening means including moving means for moving the movable surface.

6. The apparatus of claim 5, the moving means including an electromechanical actuator.

7. The apparatus of claim 1, the detecting means including a member positioned for contacting a jammed sheet in the post-roller path.

8. The apparatus of claim 1, the detecting means including at least one monitor for determining a presence of a sheet upstream of the nip along the process direction.

9. The apparatus of claim 1, the detecting means including at least one monitor for determining a presence of a sheet downstream of the output opening along the process direction.

10. The apparatus of claim 1, the detecting means including a first monitor for determining a presence of a sheet upstream of the nip along the process direction and a second monitor for determining a presence of a sheet downstream of the output opening along the process direction.

11. The apparatus of claim 1, wherein the first and second rollers are fuser rollers.

12. The apparatus of claim 11, further comprising a charge-retentive member upstream of the nip.

13. An apparatus useful in moving sheets, comprising:

a first roller and a second roller, forming a nip therebetween;

means defining a substantially enclosed post-roller path downstream of the nip along a process direction toward an output opening, the means defining the post-roller path including at least one movable surface; and opening means for increasing a size of the post-roller path, the opening means including moving means for moving the movable surface, and the moving means including an electromechanical actuator.

14. The apparatus of claim 13, wherein a dimension of the post-roller path decreases from the nip to the output opening.

15. The apparatus of claim 13, further comprising detecting means for detecting a jam condition within the post-roller path.

16. The apparatus of claim 15, the detecting means including a member positioned for contacting a jammed sheet in the post-roller path.

17. The apparatus of claim 15, the detecting means including at least one monitor for determining a presence of a sheet upstream of the nip along the process direction.

18. The apparatus of claim 15, the detecting means including at least one monitor for determining a presence of a sheet downstream of the output opening along the process direction.

19. The apparatus of claim 15, the detecting means including a first monitor for determining a presence of a sheet upstream of the nip along the process direction and a second monitor for determining a presence of a sheet downstream of the output opening along the process direction.

20. The apparatus of claim 15, wherein the first and second rollers are fuser rollers.

21. The apparatus of claim 20, further comprising a charge-retentive member upstream of the nip.

* * * * *